US005094143A

United States Patent [19]

Andersen, Jr.

[11] Patent Number: 5,094,143

[45] Date of Patent: Mar. 10, 1992

[54] PORT MOUNTED FLUID CONTROL VALVE CONSTRUCTION

[75] Inventor: Robert E. Andersen, Jr., Hoffman Estates, Ill.

[73] Assignee: Parker-Hannifin Corporation, Cleveland, Ohio

[21] Appl. No.: 602,996

[22] Filed: Oct. 24, 1990

[51] Int. Cl.[5] ..... F15B 11/00; F15B 13/00

[52] U.S. Cl. ..... 91/462; 92/164; 137/884; 285/191

[58] Field of Search ..... 91/462, 464, 465; 137/884; 92/163, 164; 285/185, 123, 191, 131

[56] References Cited

U.S. PATENT DOCUMENTS

| | | | |
|---|---|---|---|
| 1,592,850 | 7/1926 | Hansen | 285/131 |
| 2,953,118 | 9/1960 | Flick et al. | 91/462 |
| 3,233,523 | 2/1966 | Passaggio | 92/164 |
| 3,286,797 | 11/1966 | Leibfritz et al. | 92/164 |
| 3,559,537 | 2/1971 | Faure | 91/462 |
| 4,211,150 | 7/1980 | Framberg | 92/164 |
| 4,614,370 | 9/1986 | Gartner | 285/191 |
| 4,651,625 | 3/1987 | Hoge | 91/461 |

FOREIGN PATENT DOCUMENTS

| | | | |
|---|---|---|---|
| 811200 | 4/1959 | United Kingdom | 285/191 |

*Primary Examiner*—Edward K. Look

*Assistant Examiner*—Hoang Nguyen

*Attorney, Agent, or Firm*—Ralph E. Jocke

[57] ABSTRACT

A port mounted fluid control valve construction (18) is mounted to a pneumatic cylinder (10) through the first port (31) and second port (37) of the cylinder. The construction includes a removable valve body portion (22) which is detachable from a manifold portion (20). A tube (34) extends from the manifold portion to an adapter body (36). The manifold portion includes a first inlet (42) which extends to a first outlet (50) through a first passage (52). An ear (44) extends in the first passage. A spud fitting (100) which includes cutouts (110) which enables fluid to pass therethrough, is mounted in the first port of the cylinder. The spud fitting includes a threaded opening which accepts a fastener (102). The fastener extends through ear (44) and holds the manifold adjacent the cylinder. The adapter body includes first aperture (122) which is in fluid communication through the adapter body with the tube. A second spud fitting (100') is mounted in the second port of the cylinder. A second fastener (140) extends through the adapter body and is accepted into the second spud fitting to hold the adapter body adjacent the cylinder and in fluid communication with the second fitting. Selectively changing the condition of the valve body enables compressed air to be delivered or exhausted from the ports of the cylinder.

24 Claims, 8 Drawing Sheets

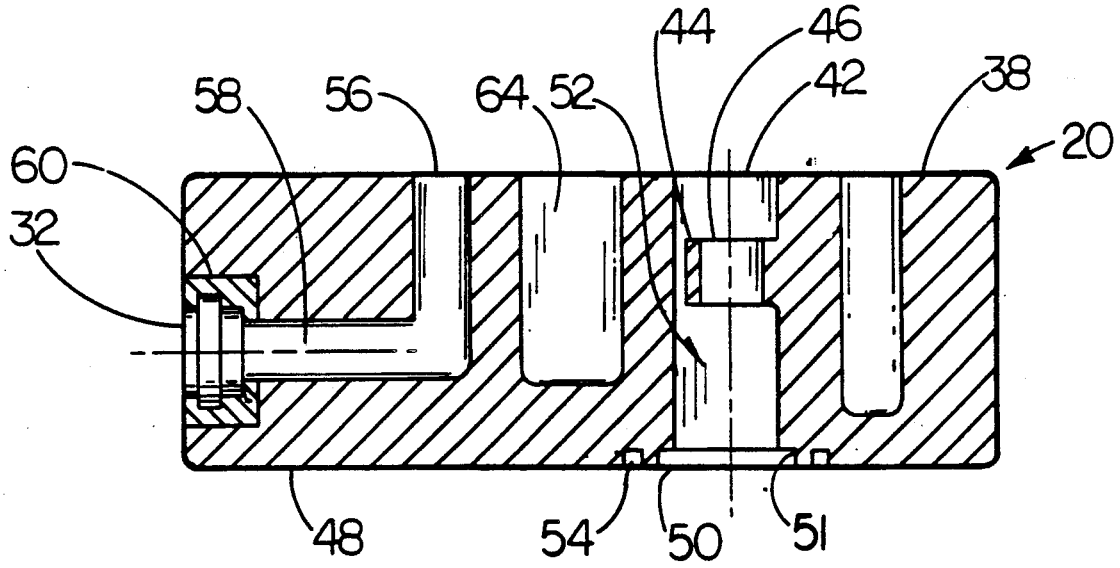
FIG. 6
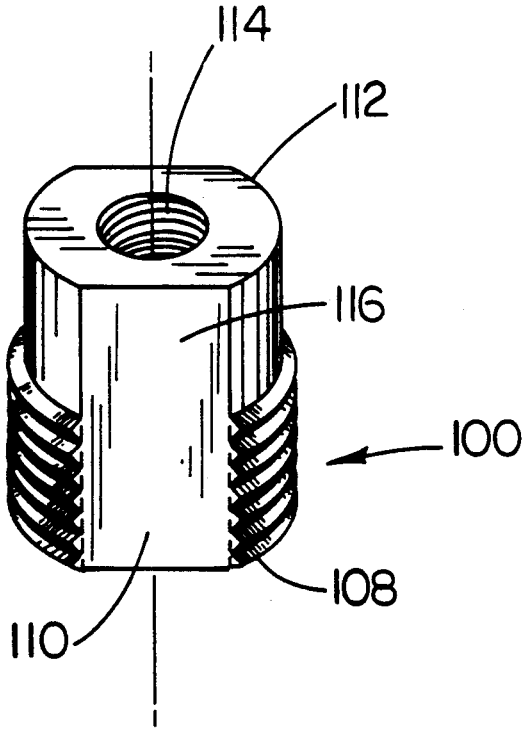
FIG. 7
Need Drawing
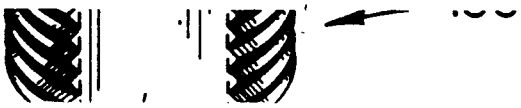

PORT MOUNTED FLUID CONTROL VALVE CONSTRUCTION

TECHNICAL FIELD

This invention relates to fluid valves, such as pneumatic valves. Specifically, this invention relates to apparatus for mounting a pneumatic valve directly to a pneumatic cylinder in a manner that does not require modification of the cylinder.

BACKGROUND ART

Fluid power cylinders, such as pneumatic cylinders, are well known in the prior art. They are used to harness power from a fluid under pressure and to convert that power into motion.

A typical fluid power cylinder includes a cylindrical internal cavity which houses a movable piston. A rod is attached to the piston. The rod is moved selectively inward or outward by delivering fluid to the cavity on either side of the piston. Pneumatic cylinders typically have end caps that close each end of the cylindrical cavity. Each end cap includes a port into which air is delivered to move the piston and its attached rod.

When air is delivered under pressure to a first port of a pneumatic cylinder, air must be able to exhaust from the opposed second port. If air could not exhaust from the opposed side of the piston, the moving piston would eventually compress the air on the opposite side. When the pressure on both sides equalized, the piston would stop moving.

Pneumatic control valves are typically used to selectively deliver fluid to the ports in the end caps of the cylinder. In most cases, the same valve also controls exhausting the air from the opposed port as the piston moves. Many types of pneumatic control valves are known in the prior art.

A very useful type of pneumatic control valve design is one that uses a valve body and a detachable manifold. The valve body includes the control elements and other components necessary to route fluid between a plurality of openings, all of which are in a surface on the underside of the valve body. A mating manifold assembly includes openings which accept tubes or other conduits which are connected to the ports of the cylinder. The manifold also includes an opening that is connected to a source of compressed air. Often the manifold also includes openings through which the air exhausted from the cylinder is discharged.

The manifold also includes a plurality of internal passages which open at an outer face. The openings in the outer face of the manifold correspond to the openings in the underside of the valve body. The valve body is attached to the manifold so that the respective openings are in fluid communication, and the valve body operates to direct the flow of fluid through the manifold to control movement of the cylinder rod.

If the valve body experiences a malfunction, the body may be readily disconnected from the manifold and a substitute installed. This is accomplished without disconnecting the tubing connectors which supply compressed air and deliver and accept fluid from the ports of the cylinder. This construction saves considerable downtime when there is a malfunction.

Various manufactures of pneumatic control valves have standardized the openings in their respective valve bodies and manifolds so that any valve body of a particular type can be installed in place of a defective one.

This standardization further reduces downtime because a user may keep a limited number of spare valve bodies on hand and still be able to repair a large number of valves.

In some applications it is desirable to mount a pneumatic control valve directly on a pneumatic cylinder. To accomplish this, the valve must be attached to the cylinder with fasteners. Unfortunately, some types of cylinders have end caps that cannot be drilled or otherwise modified to accept fasteners used for mounting a valve.

To overcome this problem, others have devised pneumatic control valves which may be directly mounted on a pneumatic cylinder through the threaded ports on the cylinder's end caps. Such a valve construction is shown in U.S. Pat. No. 4,651,625. This patent discloses a valve which uses a complex fastener fitting to connect the valve and attach it to the cylinder through the port. In addition to being complex and potentially costly, the construction disclosed in this patent presents the drawback that it does not lend itself to an interchangeable valve body construction. If there is a problem with the valve shown in this patent, the entire assembly must be removed from the cylinder and replaced.

Another cylinder mounted pneumatic control valve construction is shown in U.S. Pat. No. 3,233,523. This patent discloses a valve which includes a manifold mounted to the cylinder. The manifold is attached to the port using a fitting which is threaded at both ends. The problem with this approach is that the valve must be turned to install it on the fitting. This is cumbersome and time consuming. In addition, the valve may not be at the desired position when the fitting is fully tightened. This requires the valve to be over tightened on the fitting which could damage the seal and cause failures.

Another approach to mounting a pneumatic control valve on a cylinder is shown in U.S. Pat. No. 2,953,118. This design uses a threaded straight through fitting. The drawback of this design is that it would only be suitable for use with a very specialized valve body which is made to have ports that are in alignment with the fitting. Standardized types of valve bodies that are already in use in many applications could not be adapted to work with this construction.

Thus there exists the need for a port mounted fluid control valve construction that is adaptable to standardized types of removable pneumatic valve bodies, that is simpler to install and less expensive to manufacture.

DISCLOSURE OF INVENTION

It is an object of the present invention to provide a port mounted fluid control valve construction that is suitable for use with removable valve bodies.

It is a further object of the present invention to provide a port mounted fluid control valve construction that is simple to use and inexpensive to produce.

It is a further object of the present invention to provide a port mounted fluid control valve construction that is readily attachable and detachable from a fluid power cylinder.

It is a further object of the present invention to provide a port mounted fluid control valve construction that is readily adaptable to fluid power cylinders of differing configurations.

Further objects of the present invention will be made apparent in the following Best Modes for Carrying Out the Invention and the appended claims.

The foregoing objects are accomplished by a port mounted fluid control valve construction which is attached to the cylinder only through the first and second ports of the cylinder. A first spud fitting is accepted into a first port in a first cylinder end cap. The first fitting is threaded at a first end which is accepted into the threaded port. A pair of cutouts in the threaded portion enables air to flow through the fitting and into (and out of) the first port.

The first fitting also includes a central portion which has a threaded opening at a second end. The second end also includes wrench flats to facilitate tightening the fitting in the port.

A manifold is positioned adjacent and in overlapping relation of the first port. The manifold includes a first outlet in a first face. The outlet is in overlapping relation of the first port of the cylinder and is in fluid communication therewith through cutouts in the fitting. The manifold also includes an inlet. The inlet is in a second face opposed of the first face. A first fluid passage in the manifold connects the inlet and the outlet.

An ear extends in the first fluid passage. The ear is recessed from the second face. A fastener extends through the ear to the threaded opening in the first spud fitting to hold the manifold and cylinder end cap adjacent. A head of the fastener is recessed from the second face and is accessible through the inlet. Thus, the fastener may be tightened or loosened with a tool through the inlet.

A second spud fitting identical to the first fitting, is positioned in the second port of the cylinder. A adapter body is positioned adjacent the second port. The adapter body includes a first aperture in overlapping relation of the second port and is in fluid communication therewith through the cut outs in the second fitting. A second fastener extends through a fastener engaging portion of the adapter body and is accepted into the threaded opening of the second fitting to hold the adapter body and the cylinder end cap adjacent.

The adapter body includes a second aperture which is in fluid communication through the adapter body with the first aperture. A tube connects the second aperture to a second outlet in the manifold. The second outlet of the manifold is in fluid communication through the manifold with a second inlet which opens on the second face of the manifold.

A valve body is attached to the manifold. The valve body includes fluid openings in alignment with the fluid inlets in the second face of the manifold. In operation, the valve body controls delivery and exhaust of air to the first and second ports of the cylinder.

BRIEF DESCRIPTION OF DRAWINGS

FIG. 6 is a cross sectional view of the manifold portion of the port mounted fluid control valve construction with the section taken along line A—A of FIG. 5.

FIG. 7 is a isometric view of a spud fitting of the port mounted fluid control valve construction.

BEST MODES FOR CARRYING OUT INVENTION

Figure 1:
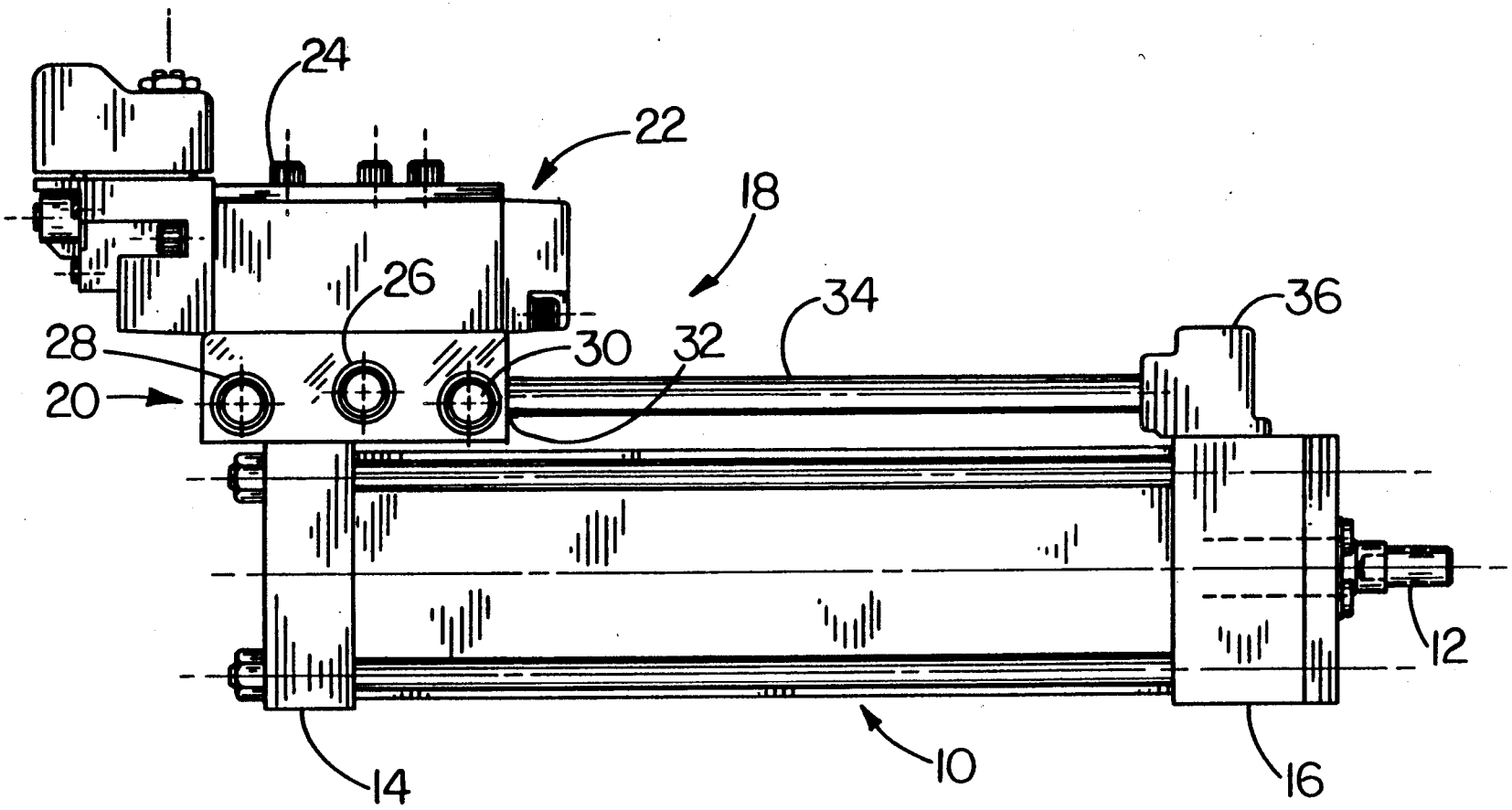
FIG. 1 is a fluid power cylinder with the port mounted fluid control valve construction of the present invention mounted thereon.

Referring now to the drawings and to particularly to FIG. 1, there is shown therein the preferred form of the port mounted fluid control valve construction of the present invention mounted on a pneumatic cylinder 10. The pneumatic cylinder is of conventional construction and includes a rod 12 which is extensible therefrom. Cylinder 10 also has a first end cap 14 and a second end cap 16. A piston (not shown) of conventional is movable inside the cylinder and is connected to rod 12.

The port mounted fluid control valve construction of the present invention is mounted on the cylinder 10 and is generally indicated 18. The construction includes a manifold portion 20 and a valve body portion 22. Valve body 22 is attached to manifold portion 20 by three bolts 24 which extend through the valve body portion and are accepted by the manifold portion. Valve body portion 22 in the preferred form of the invention, is a standard type of solenoid actuated valve body of the type sold under the "VALVAIR" trademark by the Parker-Hannifin Corporation.

Manifold portion 20 also has a pressure opening 26 which, in operation, is connected by a tube or other conduit to a source of compressed air. Manifold portion 20 also has a first exhaust opening 28 and a second exhaust opening 30 the purposes of which are later explained. Manifold portion 20 is positioned adjacent to a first port 31 in first end cap 14 of the cylinder (see FIG. 10).

Manifold portion 20 also has a tube outlet 32 which is in connection with a tube 34. Tube 34 extends to an adapter body 36. Adapter body 36 is positioned adjacent a second port 37 in second end cap 16 of the cylinder (see FIG. 13).

Figure 2:
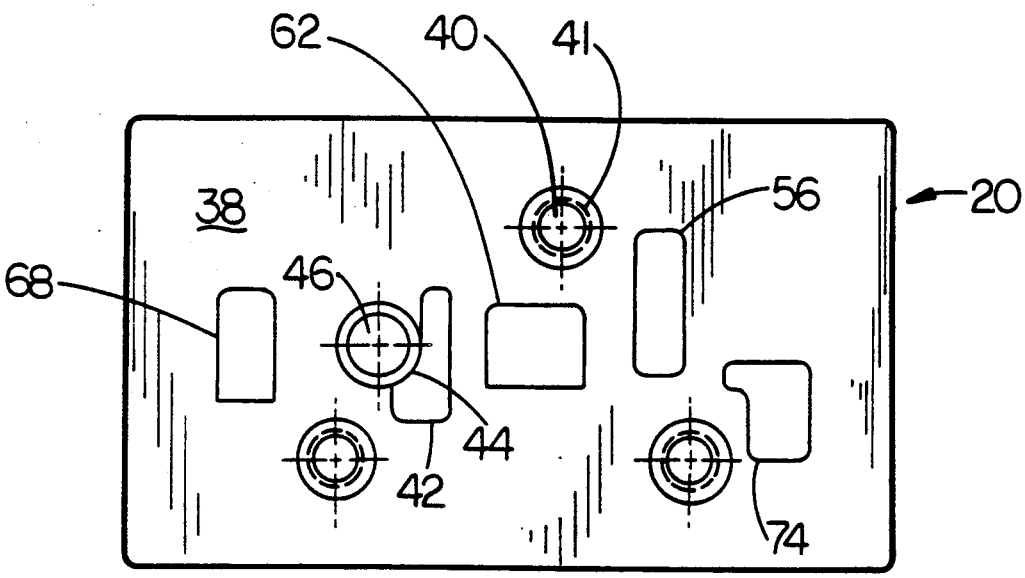
FIG. 2 is a top view of the manifold portion of the port mounted fluid control valve construction.

FIG. 2 is a top view of manifold portion 20. A top surface 38 includes three threaded holes 40 for accepting bolts 24 which hold valve body 22 to the manifold portion 20. Holes 40 are threaded holes in metal inserts 41. In the preferred form of the invention, manifold portion 20 is made from cast plastic, and threaded inserts 41 are cast therein during fabrication.

Top surface 38 also includes a first inlet opening 42. Disposed inside manifold portion 20, below first inlet opening 42, is an ear 44 which includes a hole 46. As best shown in FIG. 6, ear 44 is recessed from top surface 38.

As shown in FIG. 6, manifold portion 20 includes a lower surface 48 which is adjacent the cylinder end cap when the manifold portion is mounted on the cylinder. A circular first outlet 50 opens on surface 48 (see FIG. 5). First outlet 50 is bounded by a step 51. First outlet 50 is in fluid communication through a first passage 52 in manifold portion 20 with first inlet 42. Ear 44 extends in the first passage. First outlet 50 is surrounded by a circular recess 54, the purpose of which is later explained.

As shown in FIG. 2, upper surface 38 of manifold portion 20 also includes a second inlet 56. As shown in FIG. 6, second inlet 56 is in fluid communication through a second fluid passage 58 with tube outlet 32. In the preferred form of the invention, tube outlet 32 is an opening in a metal insert which is cast into manifold portion 20.

Figure 4:
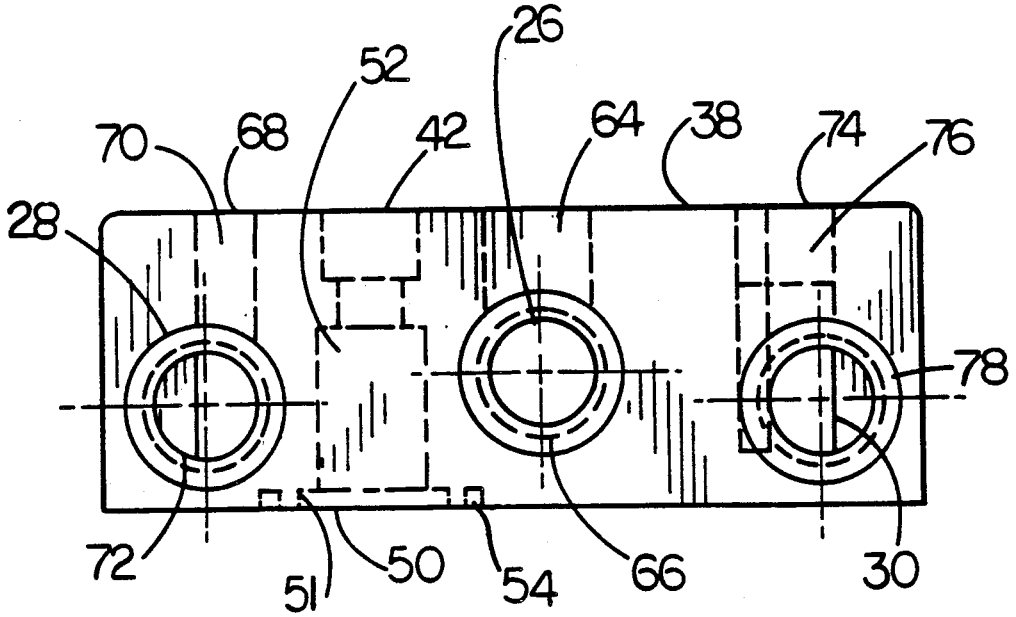
FIG. 4 is a side view of the manifold portion of the port mounted fluid control valve construction.
Figure 5:
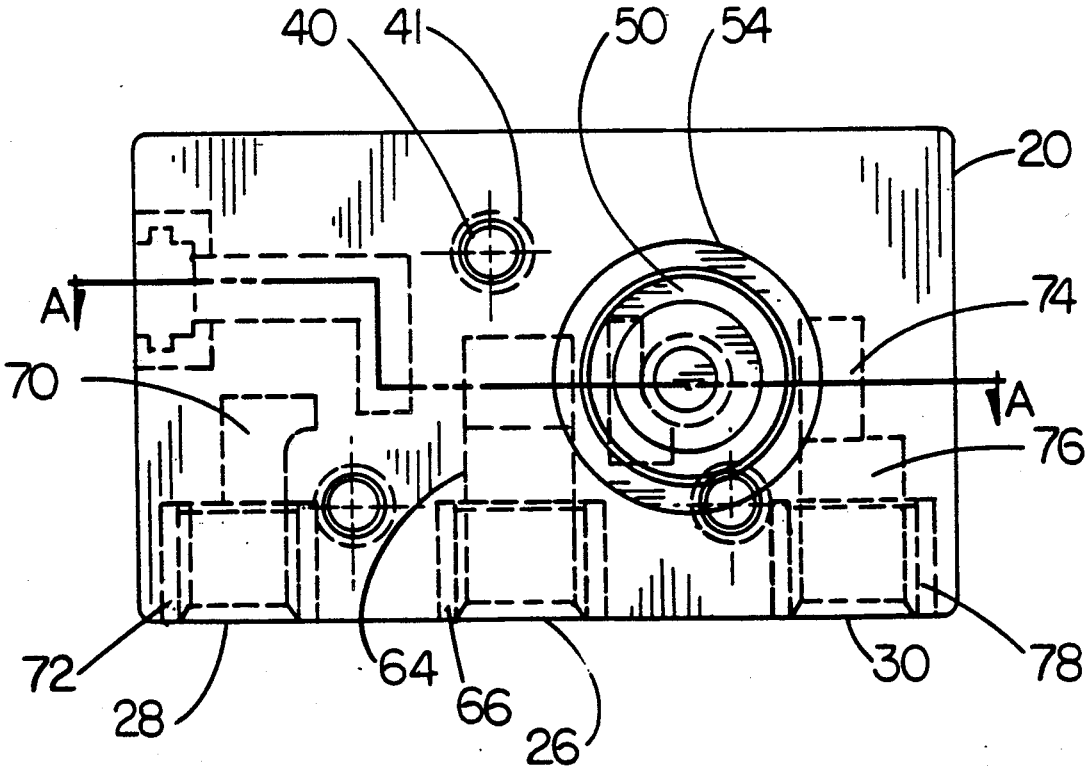
FIG. 5 is a bottom view of the manifold portion of the port mounted fluid control valve construction.

As further shown in FIG. 2, surface 38 of manifold portion 20 includes a distribution opening 62. Distribution opening 62 is in fluid communication with a pressure opening 26 through a passage 64 in manifold portion 20 (see FIGS. 4 and 6). As shown in FIGS. 4 and 5, pressure opening 26 is in a metal insert 66 which is cast into the manifold portion.

Surface 38 also includes a third inlet opening 68. As shown in FIGS. 4 and 5, third inlet opening 68 is in fluid communication with first exhaust opening 28 through a passage 70. First exhaust opening 28 is also an opening in a metal insert 72 which is cast into the manifold portion.

Surface 38 also includes a fourth inlet opening 74. As shown in FIGS. 4 and 5, fourth inlet opening 74 is in fluid communication with second exhaust opening 30 through a passage 76. Second exhaust opening 30, like the other openings, is in a metal insert 78 cast into the manifold portion.

Figure 3:
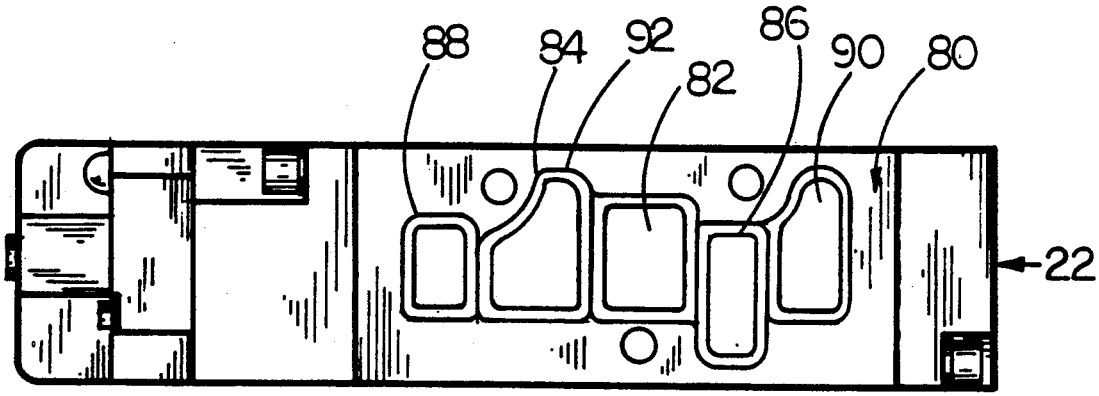
FIG. 3 is a bottom view of the valve body portion of the port mounted fluid control valve construction.

As shown in FIG. 3, valve body 22 includes an underside 80 which abuts surface 38 of the manifold portion when the valve body is mounted thereon. Surface 80 includes a pressure opening 82 which is in fluid communication with distribution opening 62 in the manifold portion when the components are assembled. Likewise, surface 80 of the valve body includes a first opening 84, a second opening 86, a third opening 88 and a fourth opening 90. These openings overlap and are in fluid communication with first inlet 42, second inlet 56, third inlet 68 and fourth inlet 74 respectively of surface 38 of the manifold portion 20 when the valve body and manifold portion are adjacent.

A gasket 92 is accepted in a recess (not separately shown) in surface 80 of the valve body to maintain the openings of the valve body and the manifold portion separate, and in fluid tight communication when the parts are adjacent.

Valve body 22 is of conventional construction well known in the art, and is responsive to electrical signals to place openings 82, 84, 86, 88 and 90 selectively in fluid communication with one another. In the preferred form of the invention, in a first condition of the valve body, pressure opening 82 is placed in fluid communication with first opening 84 through the valve body. Also in the first condition, second opening 86 is in fluid connection with fourth opening 90. In a second condition of the valve body, pressure opening 82 is in fluid communication with second opening 86 while first opening 84 and third opening 88 are in fluid communication. As later explained, changing the condition of the valve body enables compressed air to be supplied selectively to the sides of the piston inside the pneumatic cylinder, while air on the side opposed to that supplied with compressed air is enabled to exhaust.

Figure 10:
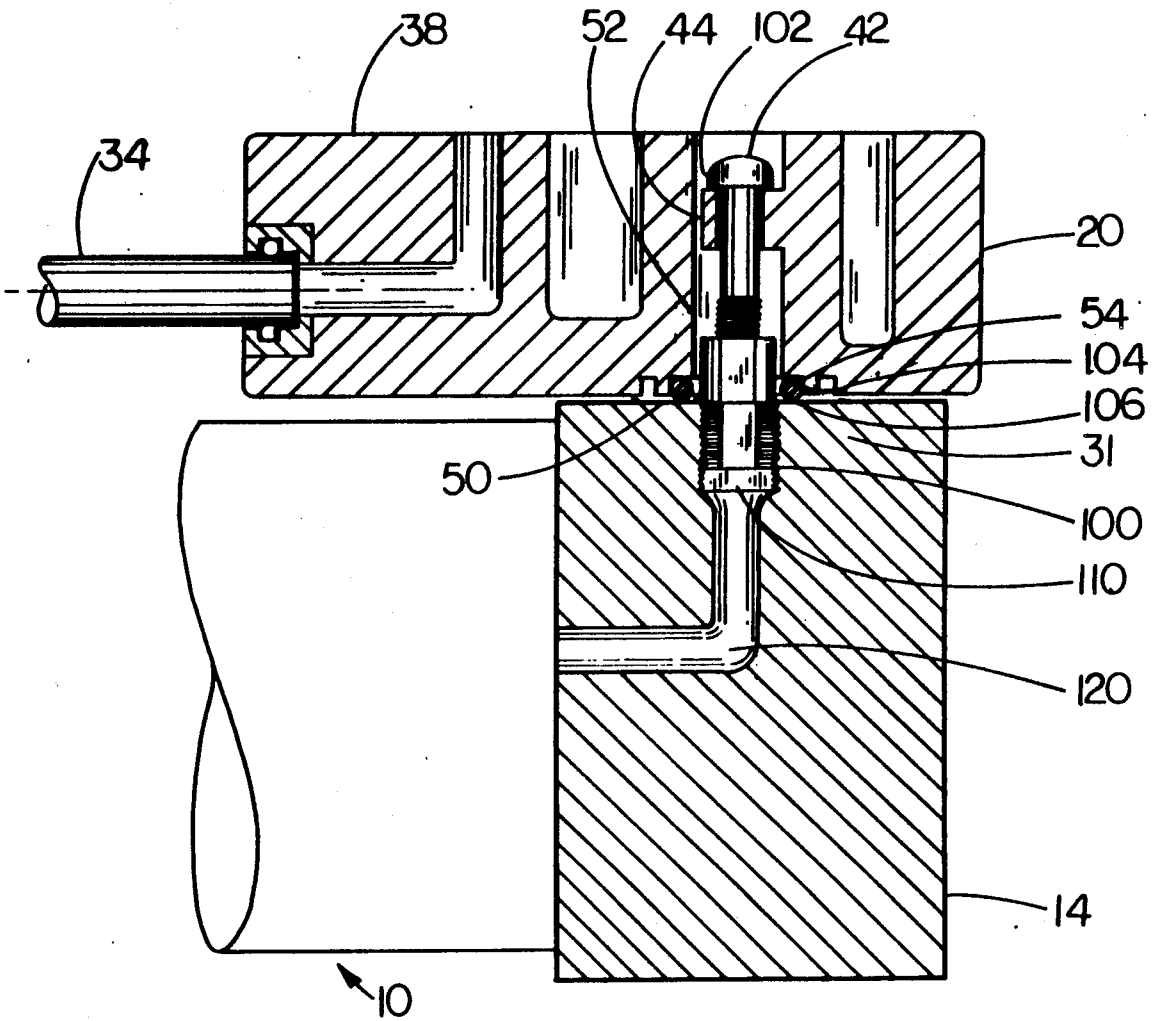
FIG. 10 is a cross sectional view of the manifold portion and spud fitting of the port mounted fluid control valve construction installed on a first end cap of a cylinder.

As shown in FIG. 10, manifold portion 20 is mounted to first end cap 14 of the pneumatic cylinder. A spud fitting 100 is installed in first port 31 of end cap 14. A threaded fastener 102 extends in first inlet 42 through hole 46 in ear 44. The fastener is threaded into the outer end of the fitting 100 as later explained. Fastener 102 securely holds manifold portion 20 to end cap 14. In addition, when fastener 102 is installed in inlet 42, it is recessed below surface 38 which enables mounting of the valve body thereon.

An o-ring 104 is positioned in adjacent step 51 of opening 50 in the manifold portion. O-ring 104 serves to seal opening 50 in fluid tight relation with a surface 106 of end cap 14 in the area surrounding cylinder port 31. The manifold may be used with cylinder ports of larger sizes by eliminating o-ring 104 and placing a larger o-ring in recess 54. To insure a fluid tight seal, the o-ring is sized so it fully surrounds the port. A manifold with multiple concentric recesses may also be produced that is suitable for use with various sized cylinder ports.

Figure 8:
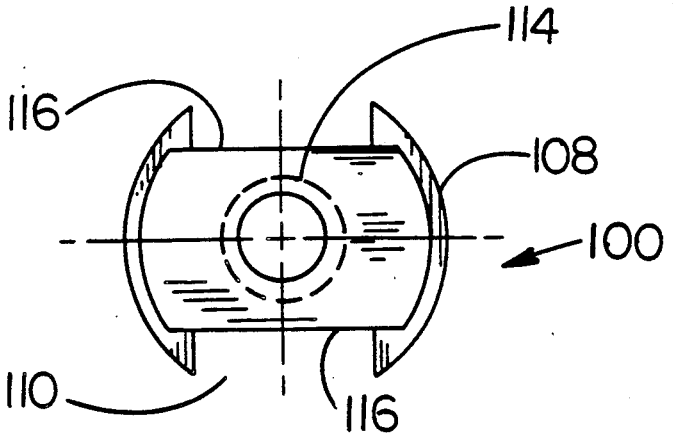
FIG. 8 is a top view of the spud fitting of the port mounted fluid control valve construction.
Figure 9:
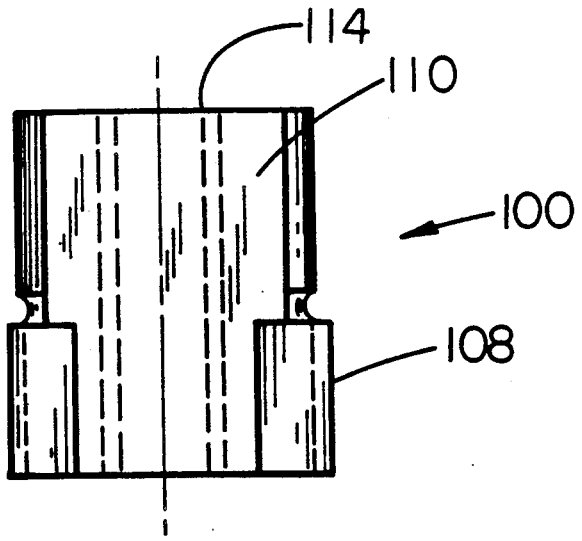
FIG. 9 is a side view of the spud fitting of the port mounted fluid control valve construction.

As shown in FIGS. 7 through 9, fitting 100 includes a first threaded outer portion 108 at a first end thereof. First threaded portion 108 mates with the threads in port 31 of the cylinder. The fitting includes a pair of cut outs 110 in the threaded portion. The cutouts enable fluid to pass into and out of the cylinder port with the fitting installed therein. A second end 112 of fitting 100 includes a threaded opening 114 which is sized to accept fastener 102. Second end 112 is also sized so that it fits snugly within first passage 52 which helps to center opening 50 over port 31 of the cylinder. Fitting 100 also includes a pair of wrench flats 116 which facilitate tightening fitting 100 in the cylinder port.

As shown in FIG. 10, when fitting 100 is installed in cylinder port 31, fluid is enabled to pass from the first inlet in surface 38 of the manifold portion, through first passage 52 and into port 31 of the cylinder through cutouts 110. End cap 14 includes a passage 120 therein which carries air from the port to the interior of the cylinder.

Figure 11:
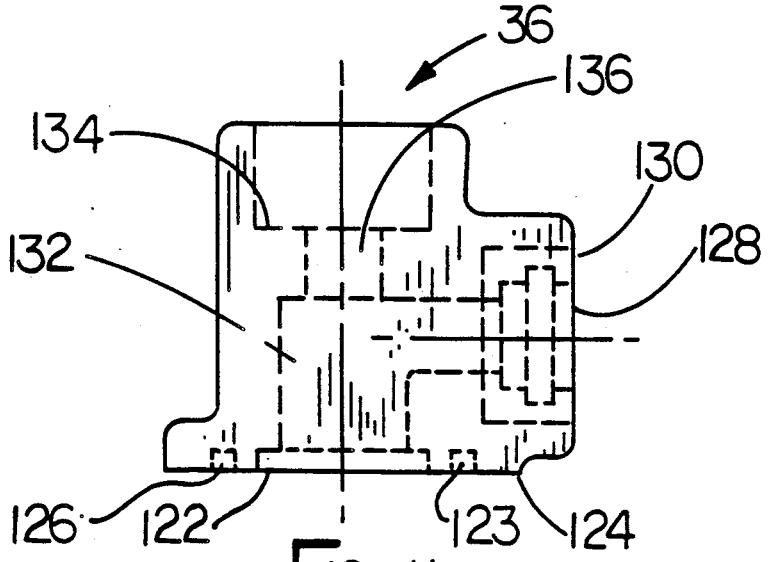
FIG. 11 is a side view of the adapter body portion of the port mounted fluid control valve construction.
Figure 12:
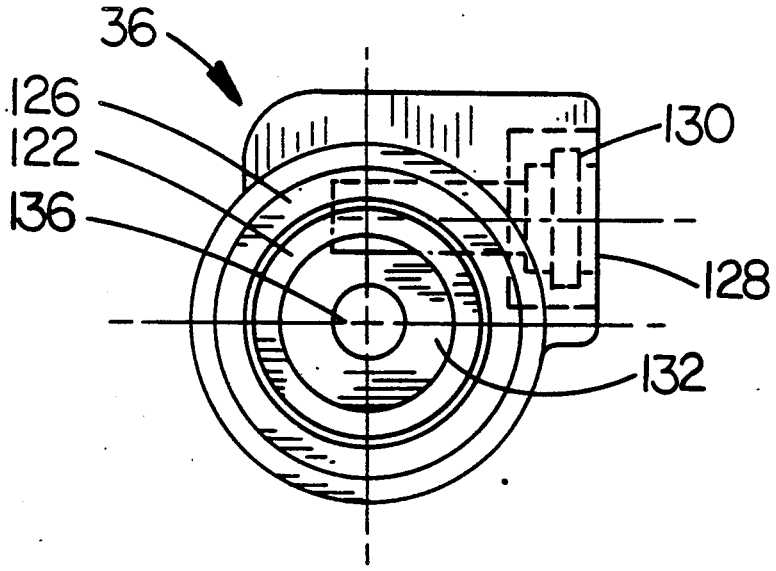
FIG. 12 is a bottom view of the adapter body portion of the port mounted fluid control valve construction.

The adapter body 36 in the preferred form of the port mounted fluid control valve construction of the present invention is mounted adjacent the second port 37 of the cylinder. The adapter body is shown in greater detail in FIGS. 11 and 12. Adapter body 36 includes a first aperture 122 in a surface 124 thereof. First aperture 122 is bounded by a step 123. A circular recess 126 in surface 124 surrounds first aperture 122 and serves a purpose later explained.

Adapter body 36 also includes a second aperture 128 which extends generally perpendicular to the first aperture. Second aperture 128 is an opening in a metal insert 130 which is cast into the plastic adapter body 36 when it is formed. An adapter passage 132 extends between the first and second apertures placing them in fluid communication through the adapter body. Adapter body 3 also includes a recessed laterally extending surface 134. A hole 136 extends through surface 134 into adapter passage 132.

Figure 13:
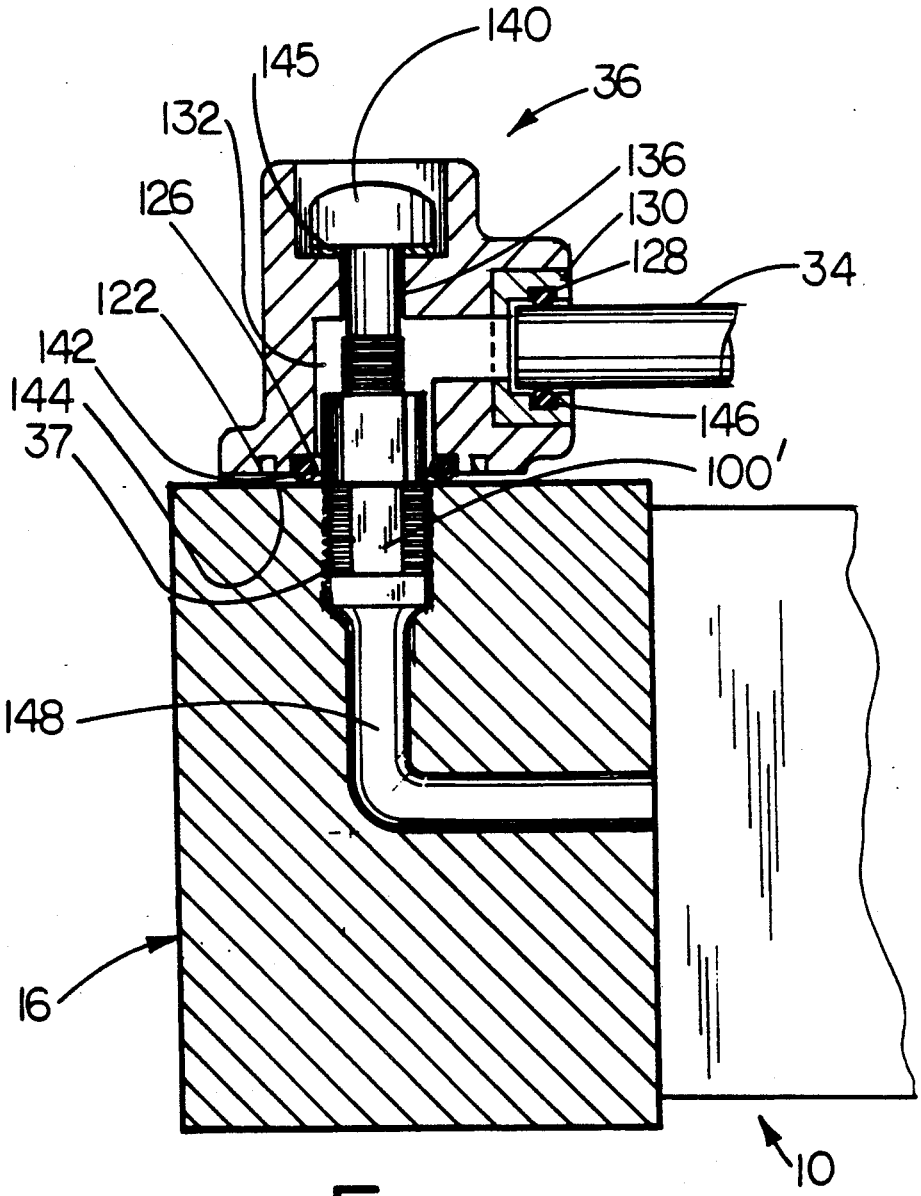
FIG. 13 is a cross sectional view of the adapter body portion and spud fitting of the port mounted fluid control valve construction installed on a second end cap of a cylinder.

FIG. 13 shows adapter body 36 mounted on second end cap 16 of the pneumatic cylinder and in fluid communication with second cylinder port 37. To attach the adapter body to the cylinder, a second spud fitting 100' is positioned in cylinder port 37. This second spud fitting is identical in all respects to the first fitting installed in the first port. A second fastener 140 extends through hole 136 and is accepted into the hole in fitting 100'. On o-ring 142 is positioned adjacent step 123 to maintain first aperture 122 and an abutting surface 144 of end cap 16 in fluid tight relation. An elastomeric washer 145 is also positioned between the head of second fastener 140 and surface 134 to prevent air leakage from the adapter body around the fastener. Recess 126 may be used in other embodiments with a larger o-ring to make the adapter body suitable for use with larger cylinder ports.

Tube 34, which extends to manifold portion 20, is accepted into second aperture 128. An o-ring 146 seals tube 34 in the aperture. Thus fluid from the inside of the cylinder is enabled to pass from a passage 148 in end cap 16, through port 37 and fitting 100', through the adapter body 36 and tube 34, and into manifold portion 20, all of which are in fluid communication.

In operation, compressed air is supplied to the pressure fitting 26 of the manifold portion of the construction. Compressed air is conducted through the manifold to distribution opening 62 in surface 38 of the manifold portion. Compressed air delivered at the distribution opening is accepted into the pressure opening 82 in the valve body 22.

When the valve body is in the first condition, the compressed air is routed through the valve body to first opening 84 in surface 80. First opening 84 is open to first inlet 42 in surface 38 of the manifold portion. First inlet 42 in turn is open to first opening 50 which is in fluid communication through cutouts in fitting 100 with first port 31 of the cylinder. As the compressed air enters first port 31 of the cylinder, it expands inside the cylinder and moves the piston therein in a first direction. Movement of the piston causes cylinder rod 12 to correspondingly move in the first direction.

As rod 12 moves in the first direction, air exhausts from second port 37. The air leaving the cylinder passes through fitting 100', adapter body 36 and tube 34, and enters the manifold through tube outlet 32. From the tube outlet the air passes through the manifold portion to inlet 56 in surface 38.

Inlet 56 is in fluid communication with second opening 86 of valve body 22. In the first condition of the valve body, second opening 86 is in fluid communication with fourth opening 90 through the valve body. The air exhausted from the cylinder passes from fourth opening 90 into inlet 74 of the manifold portion, and passes through the manifold portion and out of second exhaust opening 30.

When the condition of valve body 22 is changed to the second condition, compressed air is delivered through the manifold portion 20 and valve body 22 into second opening 56. From second opening 56, the compressed air passes out of the manifold portion through tube outlet 32, through the tube 34, and into the adapter body 36. The compressed air passes through the adapter passage in the adapter body, through the first aperture and second fitting 100' and into the second port 37 of the cylinder. The compressed air delivered through the adapter body moves the piston and rod in a second direction.

As the piston and rod move in the second direction, air exhausts from the first cylinder port 31. This exhaust air passes into the manifold portion through first opening 50 and out of the manifold portion through first inlet 42 in surface 38 of the manifold portion. The exhaust air delivered at first inlet 42 passes into first opening 84 in the valve body; which in the second condition thereof is in fluid communication with third opening 88. From third opening 88 the compressed air passes into inlet 68 in the manifold portion, and finally exhausts through first exhaust opening 72 therein.

The port mounted fluid control valve construction of the present invention is attached to the pneumatic cylinder solely through the spud fittings which thread into the cylinder ports. As the sizes and configurations of cylinder ports have been subject to standards promulgated by the National Fluid Power Association and most manufactures follow these standards, the invention is suitable for installation on most types of pneumatic cylinders. The preferred form of the present invention also presents the additional advantage that the spud fittings which attach the invention to the cylinder are both identical. Thus the installer need not be concerned with installing a particular fitting in a particular port as is the case with some other types of port mounted devices.

Thus, the port mounted fluid control valve of the invention achieves the above stated objects, eliminates difficulties encountered in the use of prior devices, solves problems and attains the desirable results described herein.

In the foregoing description, certain items have been used for brevity, clarity and understanding, however, no unnecessary limitations are to be implied therefrom because such terms are used for descriptive purposes and are intended to be broadly construed. Moreover, the descriptions and illustrations herein are examples and the invention is not limited to the exact details shown or described.

Having described the features, discoveries and principles of the invention, the manner in which it is constructed and operated and the advantages and useful results obtained, the new and useful structures, devices, elements, arrangements, parts, combinations, systems, equipment, operations and relationships are set forth in the appended claims.

I claim:

1. Apparatus for operatively attaching a valve body to a fluid power cylinder, said valve body including a first opening, said valve body delivering fluid to the first opening in a first condition of the valve body, comprising:

first fitting means for acceptance in a first port of said cylinder said first fitting means including means for passing fluid therethrough and fastener accepting means for accepting a fastener, said fastener accepting means accessible when the fitting means is positioned in the port;

manifold means for conducting fluid, said manifold means including a first outlet, said first outlet in overlapping relation of the first port of the cylinder, said manifold means further including a first inlet, said first inlet in fluid communication through said manifold means with said first outlet, said manifold means further including a first portion;

a first fastener, said first fastener extending through the first portion of the manifold means, said first fastener accepted by said fastener accepting means of said first fitting means whereby said manifold means and cylinder are held adjacent with said first outlet of the manifold means and the first port of the cylinder in fluid communication; and mounting means for holding the valve body and the manifold means adjacent and with said first opening of the valve body in fluid communication with the inlet port of the manifold means.

2. The apparatus according to claim 1 wherein the first fitting means includes a threaded portion at a first end thereof, said threaded portion including an outer diameter, said first fitting means further including at least one cutout, said cutout enabling fluid to pass through said cutout into said cylinder.

3. The apparatus according to claim 2 wherein said fitting means includes a second end opposed of the first end, and said fastener accepting means includes a threaded opening at the second end.

4. The apparatus according to claim 3 wherein the second end of said fitting means includes wrench flats for tightening said fitting means in said first port of the cylinder.

5. The apparatus according to claim 4 wherein the first outlet port of the manifold means is coaxial with the first port of the cylinder, whereby fluid passing through said cutouts in said first fitting means passes into said first port.

6. The apparatus according to claim 5 wherein the first outlet of the manifold means is circular, the first port of the cylinder is circular, and the first outlet port of the manifold means has a diameter at least as great as a diameter of the first port of the cylinder.

7. The apparatus according to claim 6 wherein the cylinder includes a generally planar first cylinder surface adjacent the first port of the cylinder, and the manifold means includes a generally planar first manifold surface adjacent the first outlet, and said apparatus further comprises first gasket means intermediate said first cylinder surface and first manifold surface, said gasket means maintaining the first outlet port and the first cylinder port in fluid tight relation.

8. The apparatus according to claim 7 wherein the first gasket means is an o-ring.

9. The apparatus according to claim 8 wherein the manifold means includes a first passage extending between the first inlet and the first outlet, and the first portion of the manifold means includes an ear in the first passage.

10. The apparatus according to claim 9 wherein the manifold means includes a second manifold surface disposed of the first manifold surface, and the first inlet is an opening in said second manifold surface, and wherein said ear is recessed in the first passage from said second manifold surface, and wherein the first fastener includes a head, the head in abutting relation of said ear below the second manifold surface.

11. The apparatus according to claim 1 wherein the cylinder further comprises a second port disposed of the first port, and the valve body further comprises a second opening, said valve body delivering fluid to the second opening in a second condition of the valve body; and the manifold means further includes a second inlet and a second outlet, said second inlet and second outlet in fluid communication through said manifold means; and wherein said apparatus further comprises:

second fitting means for acceptance in the second port, said second fitting means including means for passing fluid therethrough and fastener accepting means for accepting a fastener, said fastener accepting means accessible when the second fitting means is positioned in the second port;

an adapter body adjacent the second port of the cylinder, said adapter body including a first aperture in overlapping relation with the second port, said adapter body further including a second aperture, said second aperture in fluid communication with said first aperture through said adapter body, said adapter body further including a fastener engaging portion;

a second fastener, said second fastener extending through said fastener engaging portion of the adapter body and accepted by said fastener accepting means of said second fitting means to hold said adapter body and the cylinder adjacent with said first aperture of said adapter body in overlapping relation, whereby the second port of the cylinder is in fluid communication with first aperture; and fluid conducting means for conducting fluid from the second outlet of the manifold means to the second aperture of the adapter body.

12. The apparatus according to claim 11 wherein the second fitting means includes a threaded portion at a first end thereof, said threaded portion having an outer diameter, said second fitting means including at least one cutout, whereby fluid is enabled to pass through said cutout into said second port.

13. The apparatus according to claim 12 wherein the second fitting means includes a second end opposed of the first end, and the fastener accepting means includes a threaded opening at the second end of the fitting means, said threaded opening of said second fitting means accessible when the second fitting means is positioned in the second port.

14. The apparatus according to claim 13 wherein the second end of the second fitting means includes wrench flats for tightening the second fitting means in the second port of the cylinder.

15. The apparatus according to claim 14 wherein the first aperture of the adapter body is coaxial with the second port of the cylinder, whereby fluid passing through the cutout passes into the second port.

16. The apparatus according to claim 15 wherein the first aperture is circular and the second port is circular, and the first aperture has a diameter at least as great as a diameter of said second port of the cylinder.

17. The apparatus according to claim 16 wherein the cylinder includes a generally planar second cylinder surface adjacent the second port, and the adapter body includes a generally planar first adapter body surface adjacent the first aperture, and the apparatus further comprises second gasket means intermediate said first adapter body surface and a second cylinder surface, said second gasket means maintaining the first aperture and second port of the cylinder in fluid tight relation.

18. The apparatus according to claim 17 wherein the second gasket means is an o-ring.

19. The apparatus according to claim 18 wherein the adapter body includes an adapter passage which extends from said first aperture towards said fastener engaging portion of the adapter body, said second fastener extending through said adapter passage to said fastener accepting portion of the second fitting means.

20. The apparatus according to claim 19 wherein the fastener engaging portion of the adapter body is a surface of the adapter body extending laterally of said first aperture.

21. The apparatus according to claim 20 wherein the second aperture extends generally perpendicular of the first aperture.

22. The apparatus according to claim 21 wherein the fluid conducting means includes a tube extending from the second outlet of the manifold means to the second aperture of the adapter body.

23. The apparatus according to claim 22 wherein the second outlet of the manifold means and the second aperture are coaxial and the tube is a straight tube.

24. Apparatus for attaching a valve body to a fluid power cylinder, the fluid cylinder including a first port and a second port and having a cylinder rod therein, said rod moveable in said cylinder responsive to fluid supplied to the ports, said valve body including a pressure opening; a first opening; a second opening; a third opening; and a fourth opening, said valve body adapted for selectively placing in a first condition said first opening in fluid communication with the pressure opening while the second opening is in fluid communication with the fourth opening; and in a second condition said second opening in fluid communication with the pressure opening while the first opening is in fluid communication with the third opening, said apparatus comprising:

a first fitting means for acceptance in a first port of the cylinder, the first fitting means including a threaded portion accepted in said first port, said threaded portion including at least one cutout, and a central portion, said central portion including a threaded opening extending therethrough;

a manifold body, said manifold body including a first manifold surface and a second manifold surface, said manifold body further including a first outlet in said first surface in overlapping relation of said first cylinder port and in fluid communication therewith, said manifold body further including a first inlet in said second surface of said manifold body, said first inlet and first outlet in fluid communication through a first fluid passage in the manifold body;

said manifold body further including an ear extending in said first fluid passage, said ear including a hole therein coaxial with the threaded opening in said first fitting means;

said manifold body further including a second outlet and a second inlet, said second inlet in said second surface of said manifold body, said second inlet and said second outlet in fluid communication through a second fluid passage in said manifold body;

said manifold body further including a pressure opening for accepting fluid from a source of supply, and a distribution opening in said second surface of the manifold body, the pressure opening and distribution opening in fluid communication through a pressure passage in said manifold body;

the manifold body further including a first exhaust opening and a third inlet opening said third inlet opening in said second surface of said manifold body, said first exhaust opening and third inlet opening in fluid communication through a first exhaust passage in said manifold body;

the manifold body further including a second exhaust opening and a fourth inlet, said fourth inlet in the second surface of the manifold body, the second exhaust opening and fourth inlet in fluid communication through a second exhaust passage in the manifold body;

a first fastener extending through said hole in the ear of the manifold body and accepted into the threaded opening of the first fitting means;

means for removably mounting said valve body to said manifold body, said valve body mounted with said pressure opening in said valve body in overlapping relation of the distribution opening of said manifold body, said first opening of the valve body in overlapping relation with the first inlet of the manifold body, the second opening of the valve body in overlapping relation with the second inlet of the manifold body, the third opening of the valve body in overlapping relation of the third inlet of the manifold body, and the fourth opening of the valve body in overlapping relation with the fourth inlet of the manifold body; and fluid conducting means for conducting fluid from the second outlet from the manifold body to the second cylinder port, whereby changing the condition of the valve body selectively controls movement of the cylinder rod.

* * * * *